US010285504B2

(12) United States Patent
Jin

(10) Patent No.: US 10,285,504 B2
(45) Date of Patent: May 14, 2019

(54) FOLDABLE CHAIR

(71) Applicant: Xiamen Innovation Metal Products Co., Ltd., Xiamen (CN)

(72) Inventor: Juyoung Jin, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days.

(21) Appl. No.: 15/606,782

(22) Filed: May 26, 2017

(65) Prior Publication Data

US 2017/0340118 A1 Nov. 30, 2017

(30) Foreign Application Priority Data

May 26, 2016 (CN) ..... 2016 2 0487656 U

(51) Int. Cl.
*A47C 4/48* (2006.01)

(52) U.S. Cl.
CPC ..... *A47C 4/48* (2013.01)

(58) Field of Classification Search
CPC .... A47C 4/42; A47C 4/44; A47C 4/46; A47C 4/48; A47C 4/24; A47C 4/50; A47C 5/10
See application file for complete search history.

(56) References Cited

U.S. PATENT DOCUMENTS 1,968,333 A * 7/1934 Cross ..... A47C 4/40 297/173
2,073,155 A * 3/1937 Gladstone ..... D06F 95/002 248/150
2,381,574 A * 8/1945 Clarin ..... A47C 4/24 297/48
2,723,712 A * 11/1955 Yellen ..... A47C 3/12 297/440.11
3,112,953 A * 12/1963 Raver ..... A47C 4/40 297/18
3,123,396 A * 3/1964 Searle ..... A47C 1/026 297/114
4,025,107 A * 5/1977 Chippa ..... A47C 3/029 108/116
5,707,104 A * 1/1998 Perego ..... A47D 1/002 297/16.1
6,332,646 B1 * 12/2001 Tseng ..... A47C 4/42 297/16.1

(Continued)

FOREIGN PATENT DOCUMENTS

CN 201375237 Y 1/2010

*Primary Examiner* — James M Ference
(74) *Attorney, Agent, or Firm* — Morgan, Lewis & Bockius LLP

(57) ABSTRACT

A foldable chair comprises an annular frame, a first support leg, and a second support leg. A first end of the first support leg is hinged to a first fixed rear position of the annular frame. A second end of the first support leg is hinged to a second fixed rear position of the annular frame. A first end of the second support leg is slideably hinged to a first front portion of the annular frame, so that the first end of the second support leg is slideable along the first front portion. A second end of the second support leg is slideably hinged to a second front portion of the annular frame, so that the second end of the second support leg is slideable along the second front portion. The first support leg is pivotally hinged to the second support leg through an intermediate connecting position thereof.

13 Claims, 9 Drawing Sheets

(56) References Cited

U.S. PATENT DOCUMENTS 6,824,207 B1 * 11/2004 Lin ..... A47C 4/00 297/16.1
6,840,573 B1 * 1/2005 Yao ..... A47C 4/02 297/16.1
6,848,740 B1 * 2/2005 Reese ..... A47C 4/03 297/16.1
6,957,852 B1 * 10/2005 Hsieh ..... A47C 4/48 297/19
6,971,712 B1 * 12/2005 Tseng ..... A47C 3/029 297/16.1
7,000,983 B1 * 2/2006 Tsai ..... A47C 4/50 297/56
7,011,372 B1 * 3/2006 Hsieh ..... A47C 4/02 297/16.1
7,063,380 B1 * 6/2006 Cui ..... A47C 1/035 297/25
7,178,864 B2 * 2/2007 Hsieh ..... A47C 5/06 297/228.11
7,404,601 B2 * 7/2008 Chen ..... A47C 4/44 297/16.1
7,717,502 B2 * 5/2010 Deng ..... A47C 4/20 297/16.1
7,967,374 B2 * 6/2011 Akkad ..... A47C 4/24 297/16.1
8,955,904 B1 * 2/2015 Zhu ..... A47C 4/28 297/16.1
2004/0232740 A1 * 11/2004 Enge ..... A47C 4/286 297/16.2
2004/0245810 A1 * 12/2004 Tseng ..... A47C 4/50 297/56
2005/0077758 A1 * 4/2005 Reese ..... A47C 1/027 297/16.1
2005/0088018 A1 * 4/2005 Yao ..... A47C 4/24 297/16.1
2006/0071511 A1 * 4/2006 Tseng ..... A47C 4/28 297/16.1
2006/0107879 A1 * 5/2006 Hsieh ..... A47B 3/02 108/118
2006/0158010 A1 * 7/2006 Hsieh ..... A47C 4/48 297/16.1
2006/0249991 A1 * 11/2006 Hsieh ..... A47C 4/48 297/16.1
2007/0063550 A1 * 3/2007 Lin ..... A47C 4/42 297/16.1
2014/0042779 A1 * 2/2014 Akkad ..... A47C 4/48 297/16.1
2014/0232154 A1 * 8/2014 Chen ..... A47C 3/02 297/271.1
2017/0105527 A1 * 4/2017 Choi ..... A47C 4/24
2017/0119160 A1 * 5/2017 Frankel ..... A47C 4/28
2017/0340118 A1 * 11/2017 Jin ..... A47C 4/48

* cited by examiner

FOLDABLE CHAIR

CROSS-REFERENCE(S) TO RELATED APPLICATION

The present application claims priority to Chinese Invention Application CN 201620487656.5 filed on May 27, 2016, the entire contents of which is incorporated herein for all purposes by this reference.

TECHNICAL FIELD

The present disclosure generally relates to a chair, and more particularly, a foldable chair.

BACKGROUND

In general, a foldable chair is a temporary furnishing configured to accommodate a user. A foldable chair can be disassembled at any time and be transported to another location. Assembled on site, a foldable chair can be rapidly and conveniently erected after a user has become familiarized with the method by which the chair is unfolded and folded.

Conventional foldable chairs utilize a sub-optimal configuration to fold and unfold. A first conventional apparatus to fold a chair comprises support leg pipes which are cross-connected and formed in such a way that one of the leg pipes is telescopic. Telescopic pipes are disadvantageous as the structure is typically supported by a lock and stop device which experiences a large load. When the lock and stop device is damage the chair is no longer useable, the folding and unfolding operation becomes hazardous to the user. Another conventional apparatus is formed in such a way that the crossed pipes are divided into segments which fold during operational use. However, this is also unsatisfactory as this apparatus is complicated and does not provided a smooth folding and unfolding operation.

The information disclosed in this Background section is only for enhancement of understanding of the general background of the invention and should not be taken as an acknowledgement or any form of suggestion that this information forms the prior art already known to a person skilled in the art.

SUMMARY

The foldable chair detailed in the present disclosure address the shortcomings in the prior art detailed above.

Various aspects of the present disclosure are directed to providing a foldable chair, which utilizes a slideable support leg thereby ensuring the folding direction and the force-exerting direction are opposite to each other, guaranteeing the safety of the user, and providing a more compact structure.

In accordance with an aspect of the present disclosure, the above and other objects can be accomplished by the provision of a foldable chair, comprising an annular frame, a first support leg, and a second support leg. The structure is formed is such a way that a first end of the first support leg is hinged to a first fixed rear position of the annular frame, and a second end of the first support leg is hinged to a second fixed rear position of the annular frame. Also, a first end of the second support leg is slideably hinged to a first front portion of the annular frame, so that the first end of the second support leg is slideable along the first front portion of the annular frame. A second end of the second support leg is slideably hinged to a second front portion of the annular frame, so that the second end of the second support leg is slideable along the second front portion of the annular frame. Further, the first support leg is pivotally hinged to the second support leg through an intermediate connecting position thereof.

In some embodiments, a first sliding sleeve is disposed on the first front portion, and a second sliding sleeve is disposed on the second front portion. The first sliding sleeve is slideable along the first front portion of the annular frame, and the second sliding sleeve is slideable along the second front portion of the annular frame. The first end of the second support leg is slideably hinged to the first front portion of the annular frame through the first sliding sleeve, and the second end of the second support leg is slideably hinged to the second front portion of the annular frame through the second sliding sleeve. The structure further comprises a first protrusion disposed at the first front portion which is configured to stop the first sliding sleeve, and a second protrusion disposed at the second front portion which is configured to stop the second sliding sleeve.

In some embodiments, the foldable chair further comprises a first support tab disposed at the first fixed rear position, and a second support tab disposed at the second fixed rear position. The first end of the first support leg is hinged to the first fixed rear position by the first support tab, and the second end of the first support leg is hinged to the second fixed rear position by the second support tab.

In some embodiments, the annular frame comprises a front segment and a rear segment. A first end of the front segment is inserted into a first end of the rear segment, and a second end of the front segment is inserted into a second end of the rear segment. The structure is formed in such a way that the protrusion is disposed on the front segment.

In another embodiment, the first end of the second support leg is slideably hinged to the first front portion of the annular frame through a first sliding pin coupled to the first sliding sleeve, and the second end of the second support leg is slideably hinged to the second front portion of the annular frame through a second sliding pin coupled to the second sliding sleeve. A middle portion of the first sliding pin is recessed to form an annular groove, so that the annular groove is engaged and coupled with the first sliding sleeve and the first end of the second support leg. A first end of the first sliding pin is disposed between the first sliding sleeve and the annular frame, and the second end of the first sliding pin is disposed inside the first end of the second support leg. The first end of the first support leg is hinged to the first fixed rear position of the annular frame through a first support tab affixed to the annular frame at the first fixed rear position, and the second end of the first support leg is hinged to the second fixed rear position of the annular frame through a second support tab affixed to the annular frame at the first fixed rear position.

The foldable chair according to an exemplary embodiment of present disclosure is provided to cure the disadvantages of the prior art while having the advantages of a slideable support leg, thereby ensuring the folding direction and the force-exerting direction are opposite to each other, guaranteeing the safety of the user, and providing a more compact structure.

The methods and apparatuses of the present disclosure have other features and advantages which will be apparent from or are set forth in more detail in the accompanying drawings, which are incorporated herein, and the following Detailed Description, which together serve to explain certain principles of the present invention.

Figure 1:
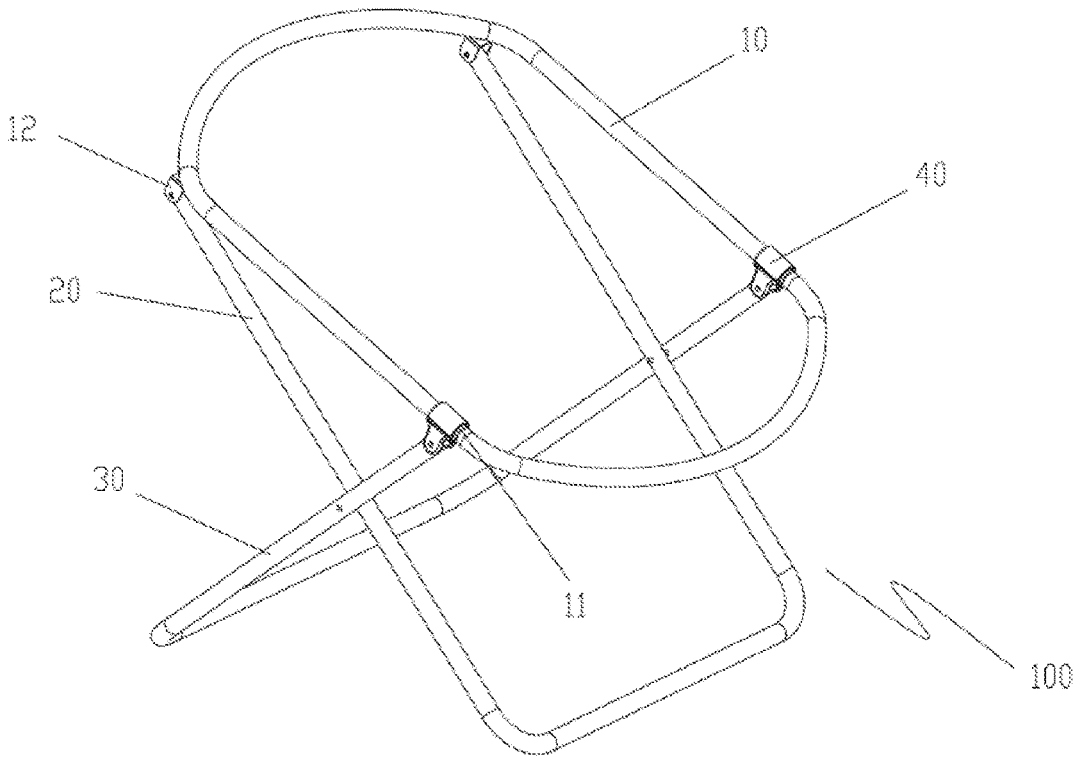
FIG. 1 is a schematic diagram according to a first exemplary embodiment of the present disclosure.
Figure 2:
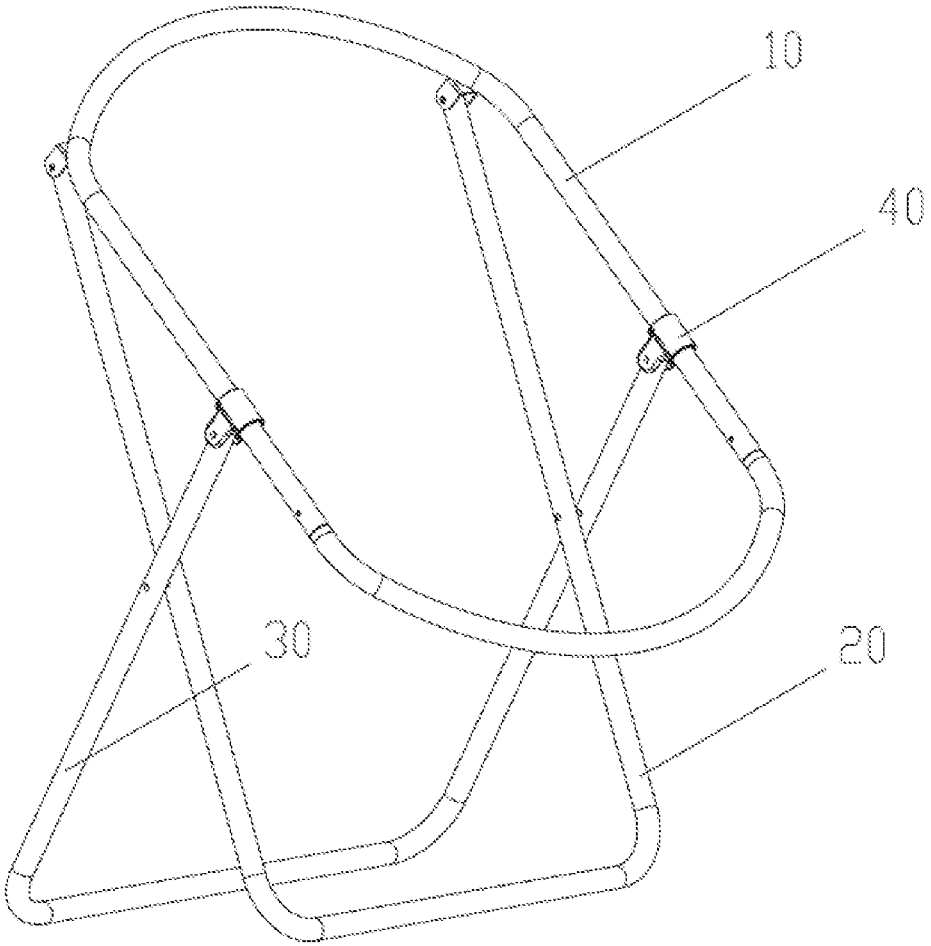
FIG. 2 is a schematic diagram according to a first exemplary embodiment of the present disclosure in a partially folded state.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawing and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the present invention as defined by the appended claims.

It will also be understood that, although the terms first, second, etc. may be used herein to describe various elements, these elements should not be limited by these terms. These terms are only used to distinguish one element from another. For example, a first subject could be termed a second subject, and, similarly, a second subject could be termed a first subject, without departing from the scope of the present disclosure. The first subject and the second subject are both subjects, but they are not the same subject. Furthermore, the terms "subject" and "user" are used interchangeably herein.

The terminology used in the present disclosure is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and or "comprising," when used in this specification, specify the presence of stated features, integers, steps, operations, elements, and or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

An aspect of the present disclosure is directed to provide a foldable chair. Referring to FIG. 1 to FIG. 4, a foldable chair 100 comprises an annular frame 10, a first support leg 20, and a second support leg 30. The structure is formed is such a way that a first end of the first support leg 20 is hinged to a first fixed rear position of the annular frame 10, and a second end of the first support leg 20 is hinged to a second fixed rear position of the annular frame 10. Also, a first end of the second support leg 30 is slideably hinged to a first front portion of the annular frame 10, so that the first end of the second support leg 30 is slideable along the first front portion of the annular frame 10. A second end of the second support leg 30 is slideably hinged to a second front portion of the annular frame 10, so that the second end of the second support leg 30 is slideable along the second front portion of the annular frame 10. Further, the first support leg 20 is pivotally hinged to the second support leg 30 through an intermediate connecting position thereof. The structure is formed in such a way that the first support leg 20 and the second support leg 30 rotate relative to each other during a folding and unfolding operation. In the present embodiment, the first support leg 20 and the second support leg 30 are 'U'-shaped pipe fittings.

Figure 3:
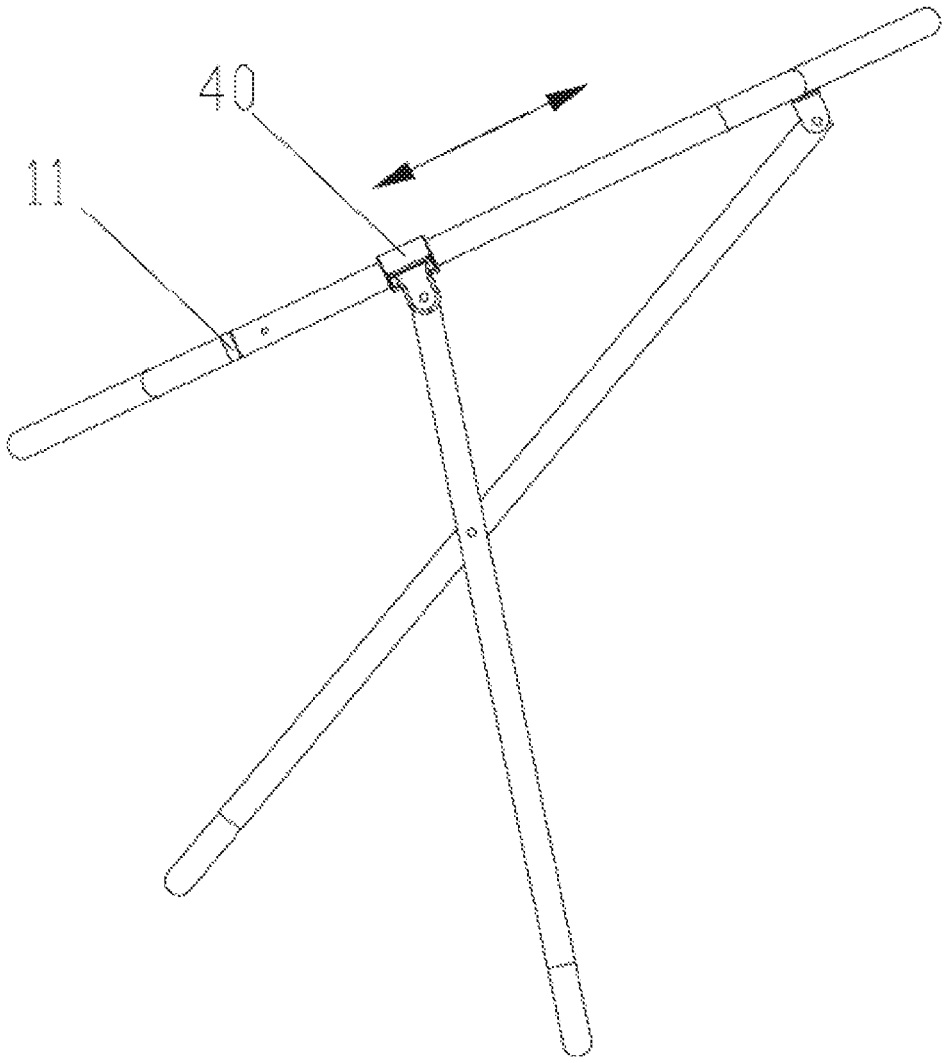
FIG. 3 is a side view according to a first exemplary embodiment of the present disclosure in a partially folded state.

In some embodiments, a first sliding sleeve 40 is disposed on the first front portion of the annular frame 10, and a second sliding sleeve 40 is disposed on the second front portion of the annular frame 10. The first sliding sleeve 40 is slideable along the first front portion of the annular frame 10, and the second sliding sleeve 40 is slideable along the second front portion of the annular frame 10. The first end of the second support leg 30 is slideably hinged to the first front portion of the annular frame 10 through the first sliding sleeve 40, and the second end of the second support leg 30 is slideably hinged to the second front portion of the annular frame 10 through the second sliding sleeve 40. The structure further comprises a first protrusion 11 disposed at the first front portion which is configured to stop the first sliding sleeve 40, and a second protrusion 11 disposed at the second front portion which is configured to stop the second sliding sleeve 40, as shown in FIG. 3. The protrusion 11 is annular shaped for ensuring a balanced force on all parts of the sliding sleeve 40.

In some embodiments, the foldable chair further comprises a first support tab 12 disposed at the first fixed rear position, and a second support tab 12 disposed at the second fixed read position. The first end of the first support leg 20 is hinged to the first fixed rear position by the first support tab 12, and the second end of the first support leg 20 is hinged to the second fixed rear position by the second support tab 12.

Figure 4:
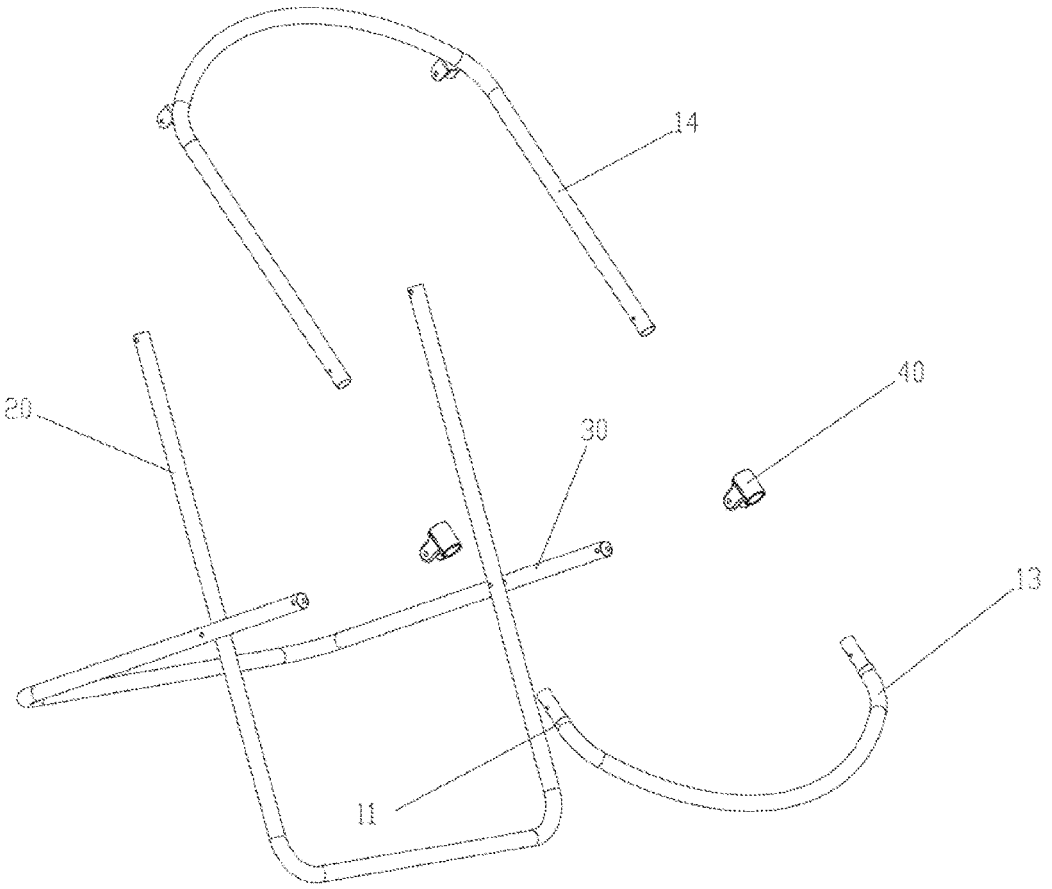
FIG. 4 is an exploded view according to a first exemplary embodiment of the present disclosure.
Figure 5:
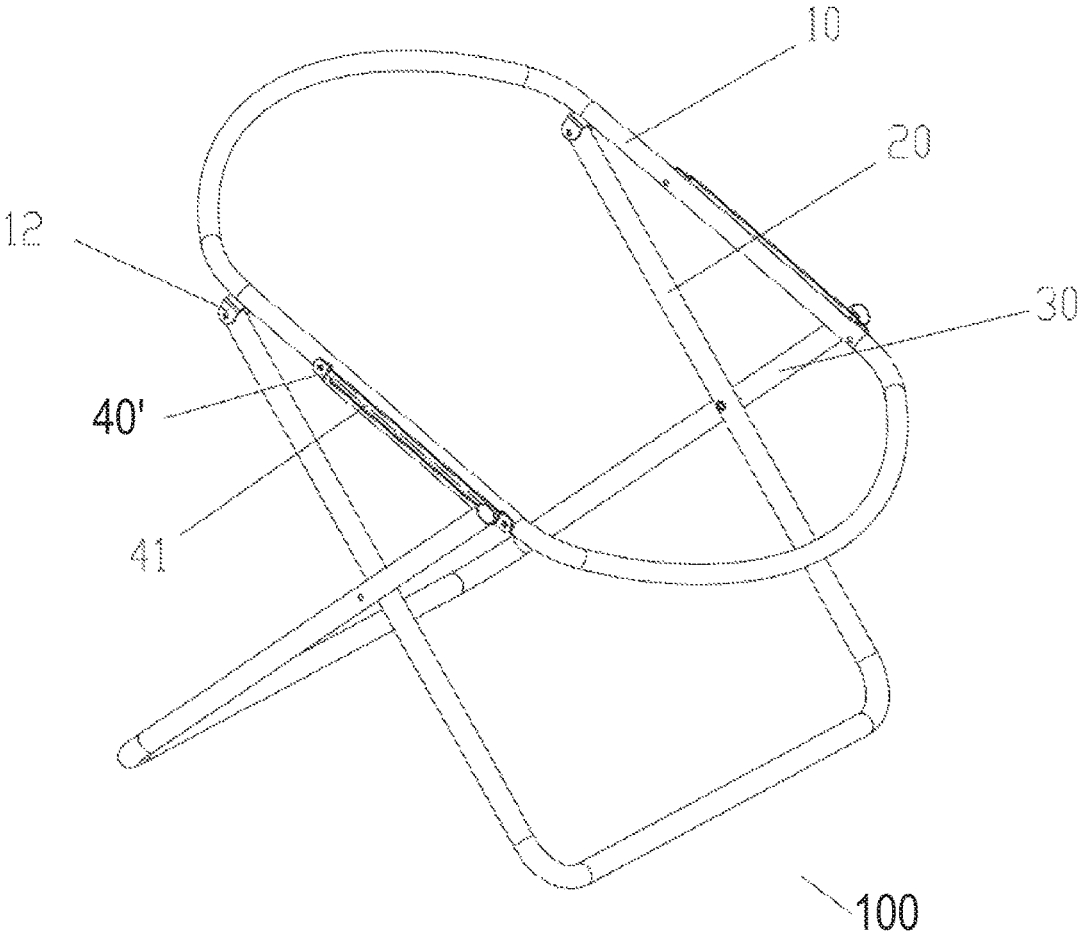
FIG. 5 is a schematic diagram according to a second exemplary embodiment of the present disclosure.
Figure 6:
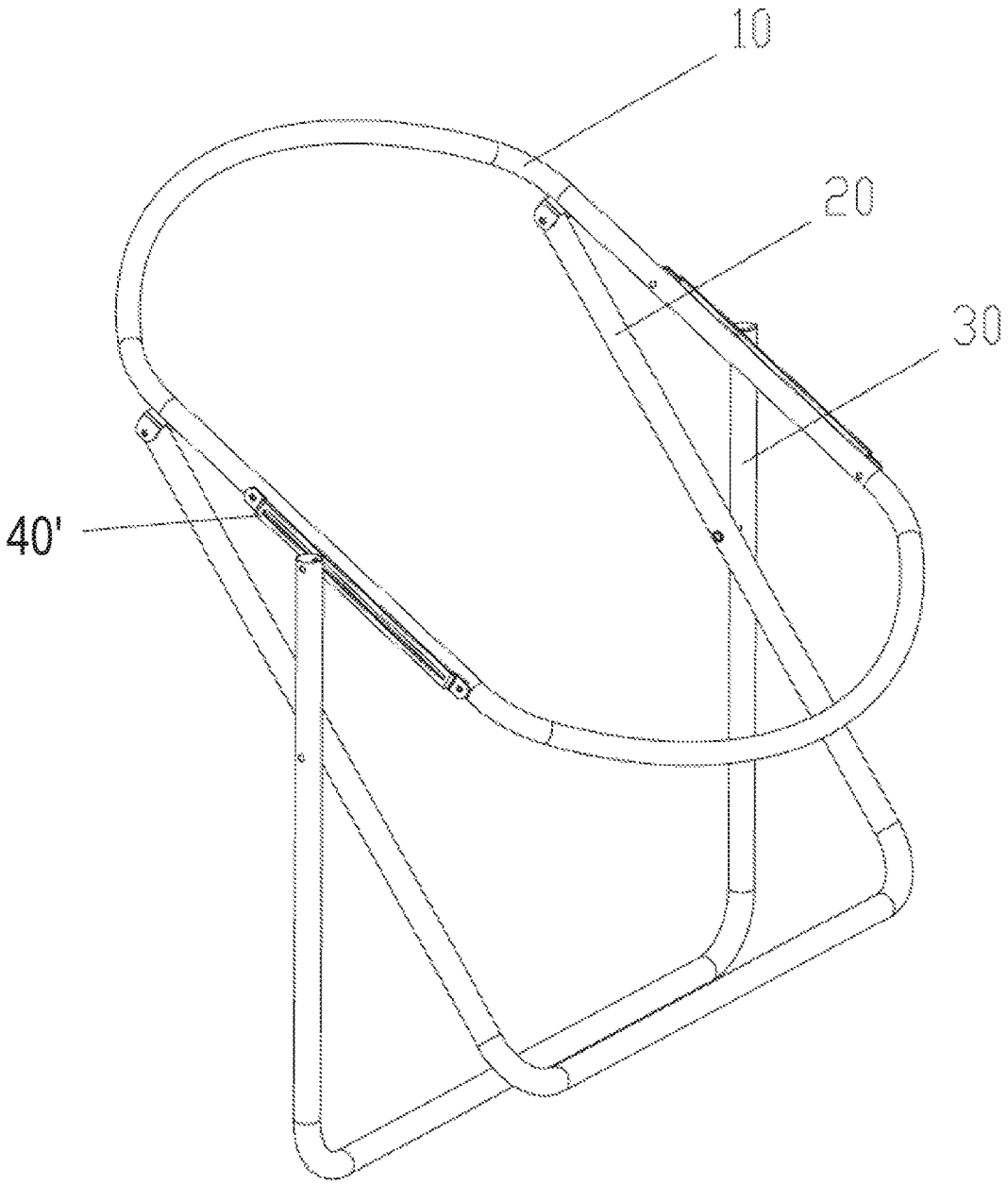
FIG. 6 is a schematic diagram according to a second exemplary embodiment of the present disclosure in a partially folded state.
Figure 7:
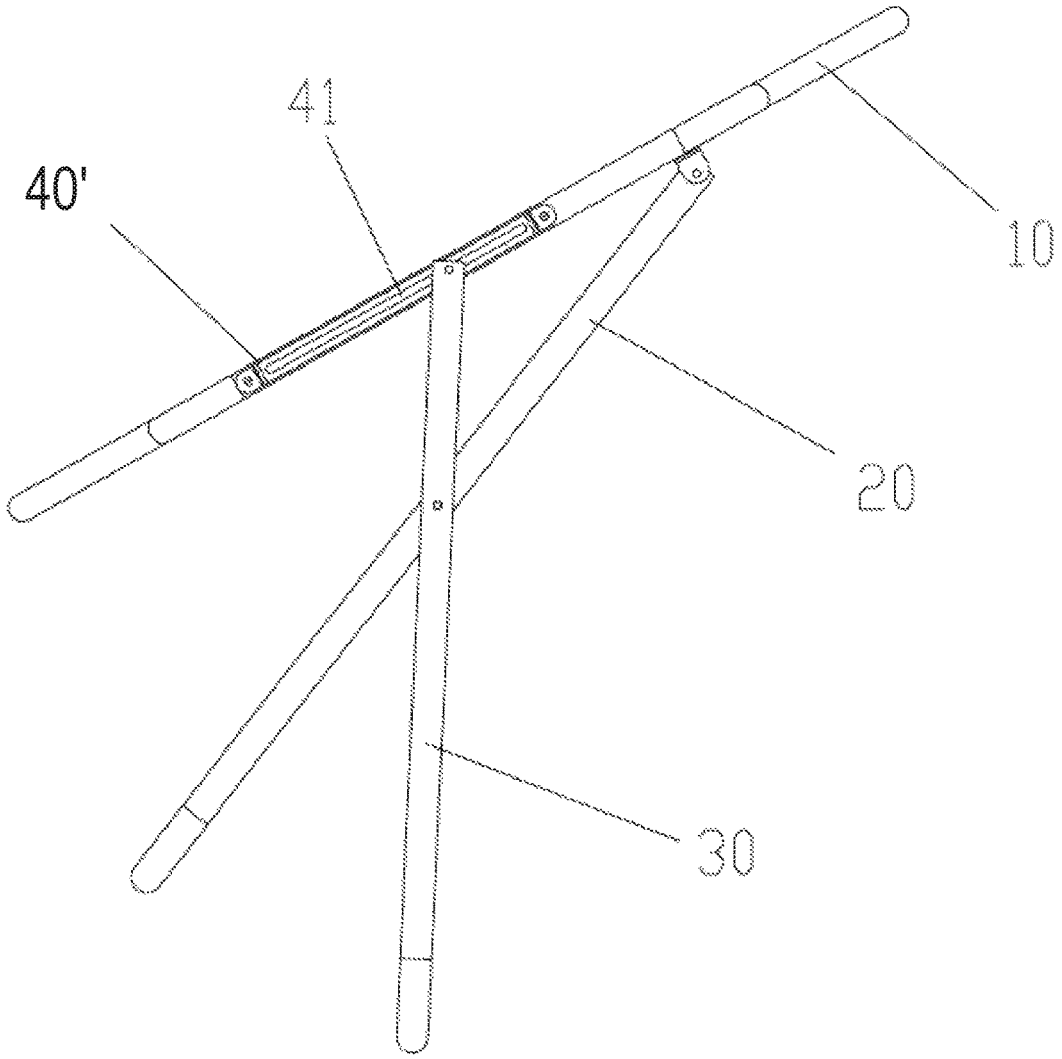
FIG. 7 is a side view according to a second exemplary embodiment of the present disclosure in a partially folded state.

In some embodiments, the annular frame 10 comprises a front segment 13 and a rear segment 14. A first end of the front segment 13 is inserted into a first end of the rear segment 14, and a second end of the front segment 13 is inserted into a second end of the rear segment 14, as shown in FIG. 4. The structure is formed in such a way that the protrusion 11 is disposed on the front segment 13. In some embodiments of the present disclosure, the front segment 13 and the rear segment 14 are integrally formed in such a way that the sliding sleeves 40 snap onto the annular frame 10.

Figure 8:
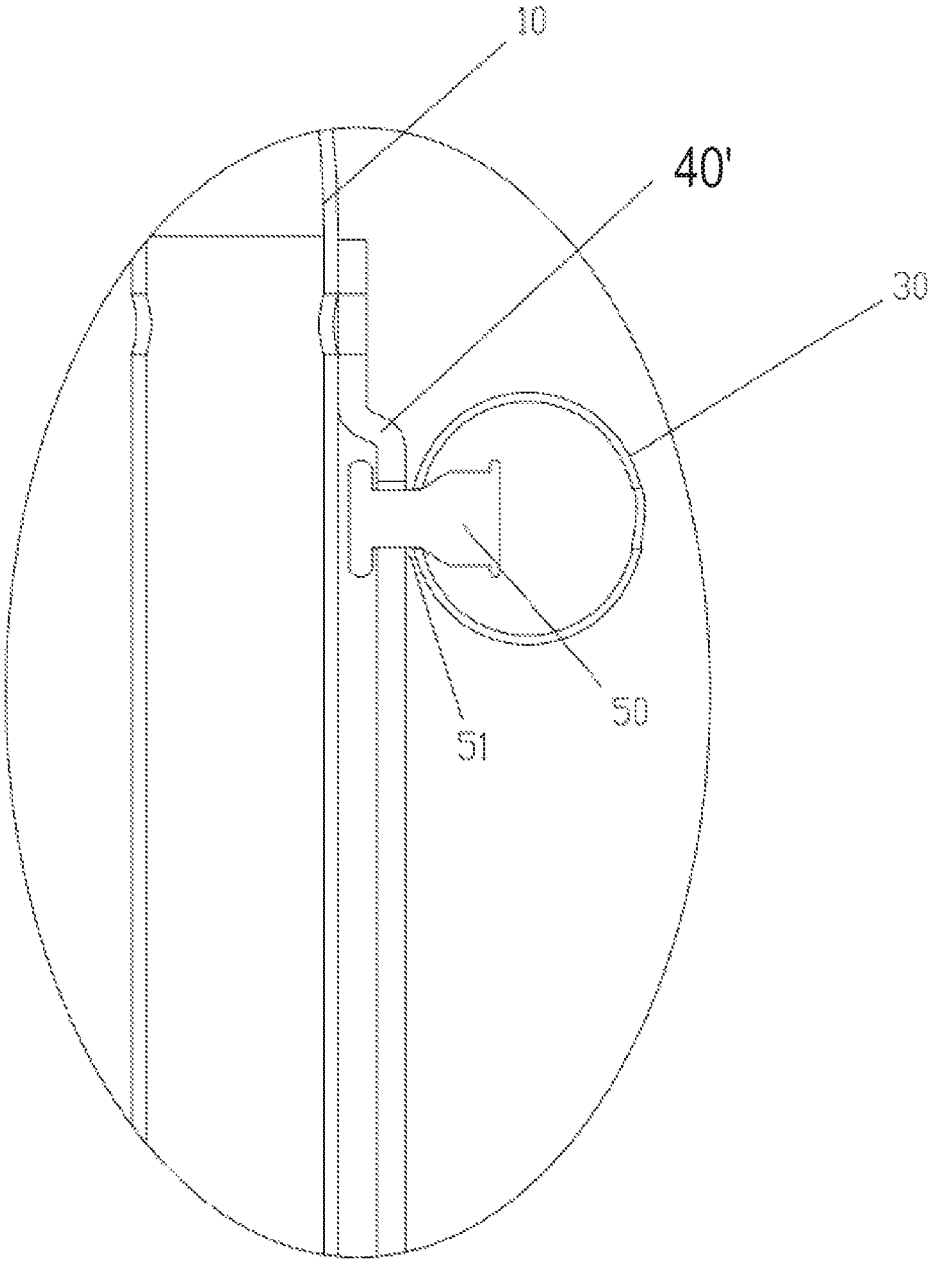
FIG. 8 is a schematic view of the engagement between the sliding pin and the sliding groove according to a second exemplary embodiment of the present disclosure.
Figure 9:
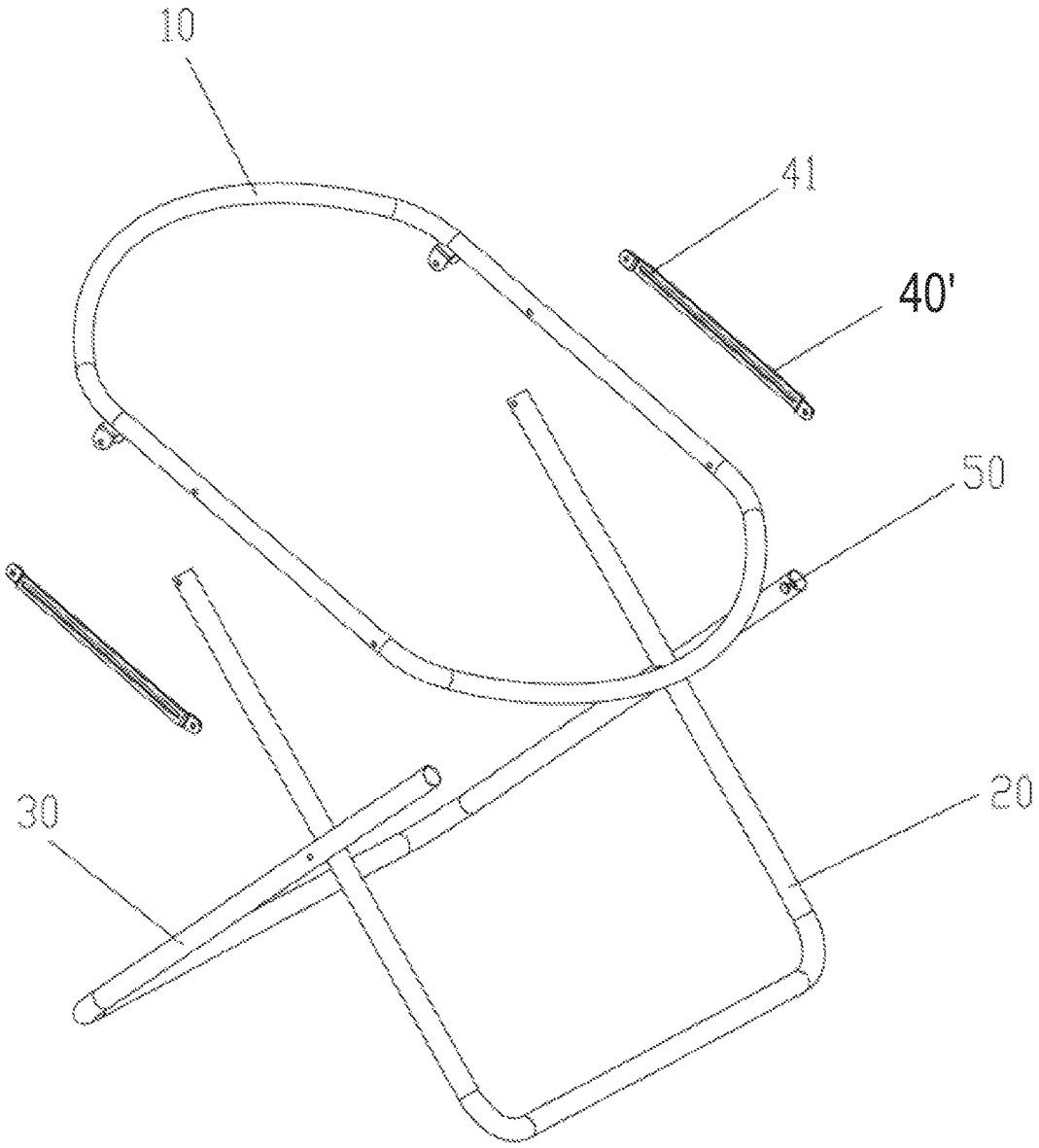
FIG. 9 is an exploded view according to a second embodiment of the present disclosure.

In another embodiment, the first end of the second support leg 30 is slideably hinged to the first front portion of the annular frame 10 through a first sliding pin 50 (as illustrated in FIG. 8) coupled to the first sliding sleeve 40, and the second end of the second support leg 30 is slideably hinged to the second front portion of the annular frame 10 through a second sliding pin 50 coupled to the second sliding sleeve 40. A middle portion of the first sliding pin 50 is recessed to form an annular groove 51, so that the annular groove 51 is engaged and coupled with the first sliding sleeve 40 and the first end of the second support leg 30. A first end of the first sliding pin 50 is disposed between the first sliding sleeve 40 and the annular frame 10, and the second end of the first sliding pin 50 is disposed inside the first end of the second support leg 30. The first end of the first support leg 20 is hinged to the first fixed rear position of the annular frame 10 through a first support tab 12 affixed to the annular frame at the first fixed rear position, and the second end of the first support leg 20 is hinged to the second fixed rear position of the annular frame through a second support tab 12 affixed to the annular frame 10 at the first fixed rear position. Referring to FIG. 5 to FIG. 9, in some embodiments, the first and second sliding pins 50 are coupled with first and second connecting pieces 40'. In an embodiment, each of the first and second connecting pieces 40' is an elongated piece fixedly coupled with a side (e.g., first or second front portion) of the annular frame 10. The connecting pieces 40' has a sliding groove 41. The first end of the sliding pin 50 is disposed in the sliding groove 41, for instance, between the connecting piece 40' and the annular frame 10, and is slidable along the sliding groove 41. The second end of the sliding pin 50 is coupled with (e.g., disposed in) the first end of the second support leg 30. The middle portion of the sliding pin 50 is recessed, forming the annular groove 51 so that the sliding pin 50 is slidable along the sliding groove 41 of the connecting piece. As such, the first end of the second support leg 30 is slidably coupled with the annular frame 10 through the connecting pieces 40' and the sliding pin 50.

Accordingly, a foldable chair according to an exemplary embodiment of the present disclosure achieves the advantages of a slideable support leg, thereby ensuring the folding direction and the force-exerting direction are opposite to each other, guaranteeing the safety of the user, and providing a more compact structure.

For convenience in explanation and accurate definition in the appended claims, the terms "upper", "lower", "up", "down", "upwards", "downwards", "inner", "outer", "inside", "outside", "inwardly", "outwardly", "interior", "exterior", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various alternatives and modifications thereof. It is intended that the scope of the invention be defined by the Claims appended hereto and their equivalents.

What is claimed is:

1. A foldable chair comprising:

an annular frame comprising an outermost periphery, wherein the outermost periphery is an enclosed periphery, wherein the enclosed periphery of the annular frame comprises a first front portion and a second front portion;

a first sliding sleeve disposed on the first front portion of the enclosed periphery of the annular frame and slidable along the first front portion of the enclosed periphery of the annular frame;

a second sliding sleeve disposed on the second front portion of the enclosed periphery of the annular frame and slidable along the second front portion of the enclosed periphery of the annular frame;

a first support leg, wherein a first end of the first support leg is hinged to a first fixed rear position of the enclosed periphery of the annular frame, and a second end of the first support leg is hinged to a second fixed rear position of the enclosed periphery of the annular frame;

a second support leg, wherein a first end of the second support leg is coupled with the first sliding sleeve, thereby slidable along the first front portion of the enclosed periphery of the annular frame, and a second end of the second support leg is coupled with the second sliding sleeve, thereby slidable along the second front portion of the enclosed periphery of the annular frame, wherein the first support leg and the second support leg are pivotally connected to each other at intermediate connecting positions thereof.

2. The foldable chair according to claim 1, further comprising:

a first protrusion disposed at the first front portion that is configured to stop the first sliding sleeve; and a second protrusion disposed at the second front portion that is configured to stop the second sliding sleeve.

3. The foldable chair according to claim 2, wherein the enclosed periphery of the annular frame comprises:

a front segment and a rear segment;

a first end of the front segment is inserted into a first end of the rear segment;

a second end of the front segment is inserted into a second end of the rear segment; and the first or second protrusion is disposed on the front segment.

4. The foldable chair according to claim 1, further comprising:

a first support tab at the first fixed rear position; and a second support tab at the second fixed read position, wherein the first end of the first support leg is hinged to the first fixed rear position by the first support tab, and the second end of the first support leg is hinged to the second fixed rear position by the second support tab.

5. The foldable chair according to claim 4, wherein the enclosed periphery of the annular frame comprises:

a front segment and a rear segment, and wherein a first end of the front segment is inserted into a first end of the rear segment, a second end of the front segment is inserted into a second end of the rear segment; and the first or second protrusion is disposed on the front segment.

6. The foldable chair according to claim 1, wherein:

the first end of the second support leg is slideably hinged to the first front portion of the annular frame through a first sliding pin coupled to the first sliding sleeve, and the second end of the second support leg is slideably hinged to the second front portion of the annular frame through a second sliding pin coupled to the second sliding sleeve.

7. A foldable chair comprising:

an annular frame comprising an outermost periphery, wherein the outermost periphery is an enclosed periphery, wherein the enclosed periphery of the annular frame comprises a first front portion and a second front portion;

a first connecting piece fixed on the first front portion of the enclosed periphery of the annular frame and comprising a first sliding groove along a direction of the first front portion of the enclosed periphery of the annular frame;

a second connecting piece fixed on the second front portion of the enclosed periphery of the annular frame and comprising a second sliding groove along a direction of the second front portion of the enclosed periphery of the annular frame;

a first support leg, wherein a first end of the first support leg is hinged to a first fixed rear position of the enclosed periphery of the annular frame, and a second end of the first support leg is hinged to a second fixed rear position of the enclosed periphery of the annular frame;

a second support leg, wherein a first end of the second support leg is slidably coupled with the first sliding groove of the first connecting piece, thereby slidable along the first front portion of the enclosed periphery of the annular frame, and a second end of the second support leg is slidably coupled with the second sliding groove of the second connecting piece, thereby slidable along the second front portion of the enclosed periphery of the annular frame, wherein the first support leg and the second support leg are pivotally connected to each other at intermediate connecting positions thereof.

8. The foldable chair of claim 7, wherein the first end of the second support leg is slidably coupled with the first sliding groove of the first connecting piece by a first sliding pin, and the second end of the second support leg is slidably coupled with the second sliding groove of the second connecting piece by a second sliding pin.

9. The foldable chair of claim 8, wherein the first sliding pin has one end disposed in the first sliding groove of the first connecting piece, the other end disposed in the first end of the second support leg, and a middle portion with an annular groove such that the first sliding pin is slidable along the first sliding groove of the first connecting piece.

10. The foldable chair of claim 8, wherein the second sliding pin has one end disposed in the second sliding groove of the second connecting piece, the other end disposed in the second end of the second support leg, and a middle portion with an annular groove such that the second pin is slidable along the second sliding groove of the second connecting piece.

11. A foldable chair comprising:

an annular frame;

a first support leg;

a second support leg;

a first sliding sleeve; and a second sliding sleeve, wherein a first end of the first support leg is hinged to a first fixed rear position of the annular frame, a second end of the first support leg is hinged to a second fixed rear position of the annular frame, a first end of the second support leg is slideably hinged to a first front portion of the annular frame, wherein the first end of the second support leg is slidable along the first front portion of the annular frame, a second end of the second support is slideably hinged to a second front portion of the annular frame, wherein the second end of the second support leg is slidable along the second front portion of the annular frame, the first support leg is pivotally hinged to the second support leg through an intermediate connecting position thereof, the first sliding sleeve is disposed on the first front portion, the second sliding sleeve disposed on the second front portion, the first sliding sleeve is slidable along the first front portion of the annular frame, the second sliding sleeve is slidable along the second front portion of the annular frame, the first end of the second support leg is slideably hinged to the first front portion of the annular frame through the first sliding sleeve, the second end of the second support leg is slideably hinged to the second front portion of the annular frame through the second sliding sleeve, the first end of the second support leg is slideably hinged to the first front portion of the annular frame through a first sliding pin coupled to the first sliding sleeve, the second end of the second support leg is slideably hinged to the second front portion of the annular frame through a second sliding pin coupled to the second sliding sleeve, and a middle portion of the first sliding pin is recessed to form an annular groove, wherein the annular groove is engaged and coupled with the first sliding sleeve and the first end of the second support leg.

12. The foldable chair according to claim 11, wherein a first end of the first sliding pin is disposed between the first sliding sleeve and the annular frame, and the second end of the first sliding pin is disposed inside the first end of the second support leg.

13. The foldable chair according to claim 12, wherein the first end of the first support leg is hinged to the first fixed rear position of the annular frame through a first support tab that is affixed to the annular frame at the first fixed rear position; and the second end of the first support leg is hinged to the second fixed rear position of the annular frame through a second support tab that is affixed to the annular frame at the first fixed rear position.

* * * * *